United States Patent [19]

Meyer

[11] Patent Number: 4,964,455

[45] Date of Patent: Oct. 23, 1990

[54] METHOD OF MAKING THIXOTROPIC METAL PRODUCTS BY CONTINUOUS CASTING

[75] Inventor: Jean-Luc Meyer, Voiron, France

[73] Assignee: Aluminum Pechiney, Paris, France

[21] Appl. No.: 362,317

[22] Filed: Jun. 6, 1989

[30] Foreign Application Priority Data

Jul. 7, 1988 [FR] France ..... 88 09616

[51] Int. Cl.[5] ..... B22D 27/02

[52] U.S. Cl. ..... 164/468; 164/504; 164/900

[58] Field of Search ..... 164/468, 504, 900

[56] References Cited

U.S. PATENT DOCUMENTS 4,577,676 3/1986 Watson ..... 164/468

FOREIGN PATENT DOCUMENTS 705762 3/1954 United Kingdom ..... 164/504

*Primary Examiner*—Kuang Y. Lin

*Attorney, Agent, or Firm*—Dennison, Meserole, Pollack & Scheiner

[57] ABSTRACT

A method is disclosed for making thixotropic metal products by continuous casting by pouring liquid metal into a mold with a movable end and having upstream and downstream portions. The upstream portion has a wall made of a heat insulating material at least at its inner surface to form a hot zone, and the downstream portion has a wall made at least partially of a heat conducting material to form a cold zone. A movement is imparted to the solidifying liquid to cause circulation between the cold zone and the hot zone in order to bring about surface remelting of crystals formed in the cold zone and degeneration of dendrites.

23 Claims, 2 Drawing Sheets

METHOD OF MAKING THIXOTROPIC METAL PRODUCTS BY CONTINUOUS CASTING

The invention relates to a method of making thixotropic metal products by continuous casting.

BACKGROUND OF THE INVENTION

The term "metal products" will hereinafter refer to any product of elongated shape and circular or polyhedral section which is made of a metal such as aluminium or one of its alloys. A "thixotropic metal product" is understood as being any metal composition which has a solid primary non-dendritic phase, and more particularly a phase with dentrites which have degenerated to a point where it is in the form of substantially spheroidal particles.

These thixotropic products have great advantages over conventional ones at the moulding stage. Thus the operation requires much less energy, the cooling time is shorter, the shrink cavity formed has smaller dimensions and erosion of the dies or moulds by the metal is considerably reduced.

There are many patents which teach means of obtaining such products. For example, U.S. Pat. No. 3948650 and companion French patent no. 2141979 describe a casting method, comprising raising the temperature of a metal composition until it is in the liquid state, cooling to produce a certain solidification of the liquid, and vigorously agitating the solid-liquid mix until about 65 weight percent of the mix thus formed is in solid form with individual degenerated dentrities or nodules.

The method was subsequently improved and the improved version is disclosed in U.S. Pat. No. 3902544.

Then U.S. Pat. No. 4434837, using the above-mentioned process, provided a suitable agitating device comprising a two pole stator. The stator creates a rotating magnetic field which is displaced perpendicularly to the axis of the mould and which generates electro magnetic forces. These forces are directed tangentially to the mould and give a shearing rate of at least 500 $sec^{-1}$. U.S. Pat. No. 4457355 however provided a mould made up of two parts of different heat conductivity, and EP No. 71822 provided a mould made up of a succession of insulating and conductive sheets. In more recent patent applications, improvements in U.S. Pat. No. 4482012 consisted of using a mould formed by two chambers linked by a non-conductive joint, with the first chamber acting as a heat exchanger, while U.S. Pat. No. 4565241 recommended agitating conditions such that the ratio of the shearing rate to the solidification rate is from $2.10^3$ to $8.10^3$.

This method of obtaining thixotropic products by casting with agitation has certainly resulted in suitable products. However, prior art has arrived at arrangements using electrical inductors with a rotating field, which are responsible for imparting high rotary speeds to the solidifying metal, in a plane perpendicular to the axis of the mould, so that the metal is agitated and the dendrites broken to give the crystals the shape or spherodial particles; that is to say, the thixotropic structure is obtained by a mechanical effect.

Furthermore, as indicated in U.S. Pat. No. 4482012, it is essential to keep a close check on heat extraction from the solidifying mass. The heat exchangers provided have therefore been breakable and complicated to control, being made up of a clever assembly of that conductive and heat insulating portions, which bring the metal to a temperature as close as possible to the liquidus, while preventing it from solidifying on the walls of the mould.

SUMMARY OF THE INVENTION

Applicants are interested in manufacturing thixotropic products but wish to free themselves from the contingencies of prior art methods. They have therefore perfected a casting process wherein, according to the invention, the liquid metal is poured into a mould fitted with a movable end at one extremity and made up of two adjacent coaxial portions, wherein said portions form an upstream portion in the casting direction, described as the hot zone, with its wall made of a heat insulating material at least on the inner surface, and a downstream portion described as the cold zone, with its wall made at least partially of a heat conductive material, and wherein the external surface is cooled by a refrigerating fluid, so as to make crystals appear through solidification within the liquid contained in that portion, and so as to make a solid crust form on contact with the inner surface, the crust being rigid enough to enable the product thus formed gradually to be extracted with the aid of the movable end, characterised in that movement is imparted to the solidifying liquid, at least transferring it from the cold zone to the hot zone and vice versa in a duration of $\leqq 1$ second, to make the crystals contained in the liquid remelt at the surface and to make the dentrites degenerate.

Thus the invention comprises introducing a liquid metal into a mould made up of an upstream portion which is formed by a material with heat insulating properties at least as far as the wall in contact with the metal is concerned. This material may e.g. be of the type currently used in metal casting for the manufacture of spouts or nozzles. By reason of the reduced heat exchange in that portion, the metal is kept at a high enough temperature to prevent any crystallisation, provided that conditions are normal, i.e. that there is no external disturbance. This portion is therefore described as the "hot zone".

The upstream portion is linked by a suitable joint to a downstream portion. Unlike the upstream portion this is a very good conductor of heat, at least at the part of its height furthest downstream. Because of the ease with which it dissipates heat from the metal contained in it to the outside, this is described as the "cold zone". This portion is analogous to the ingot mold used in conventional continuous casting. It is where the crystallisation process begins and where a crystalline layer develops from the wall, which is cooled externally by a refrigerating fluid. The crystalline layer is rigid enough to allow the cast product to be extracted gradually with the aid of the movable end. The layer is bounded by the "solidification boundary", a surface with the general profile of a meniscus with its peak pointing downstream. A "mushy zone" consisting of a mixture of liquid and generally dendritic solid particles forms inside the crystalline layer. The solid particles will gradually be incorporated in the solidification boundary and will enable the solid part to develop and the casting process of progress.

There is thus a unit made up of a hot zone and a cold zone, respectively containing a liquid and a liquid charged with dendritic particles. A movement is imparted to the latter, causing the particles to be drawn towards the hot zone. Under these conditions the particles are found to lose at least part of their branches and tend to become spheroid. But if a clear change is to take place there must be a ripid transfer from one zone to another, at any rate taking no more than one second. The shorter the time taken, the better will be the dendrite degeneration rate. This movement from the cold zone to the hot zone is obviously accompanied by a reverse movement, so that the particles return to their original zone and can carry out a new cycle. During these cycles the particles are brought into contact with the solidification boundary and some become attached to it. The product obtained is thus at least partly formed by degenerate particles which give it at least partially thixotropic properties.

The particles preferably move at least in loops, with the loops together generating a torus with its axis substantially identical with the axis of the mould. The loops are located in meridian planes of the mould, i.e. passing through its axis, and each is entirely contained in the half plane bounded by that axis. The part of the loop along which the liquid passes from the cold zone to the hot one is preferably closer to the axis, with the portion corresponding to the return movement being close to the wall of the mould.

It will be clear from the above that there are two fundamental differences between the prior art process and the invention. In prior art the liquid circulates by rotation about the axis of the mould, i.e. in a plane perpendicular to the axis, and degeneration is obtained by breaking crystals which are kept at a substantially constant temperature. In the invention the main circulation of liquid is parallel with the axis of the mould, and degeneration is the result of heat action rather than mechanical action. This makes it necessary to keep the crystals permanently at a temperature near the liquidus with the use of sophisticated heat exchangers which are difficult to control. The means used in the invention to produce movement are far simpler than rotary field generators.

DESCRIPTION OF THE PREFERRED EMBODIMENT

Figure 1:
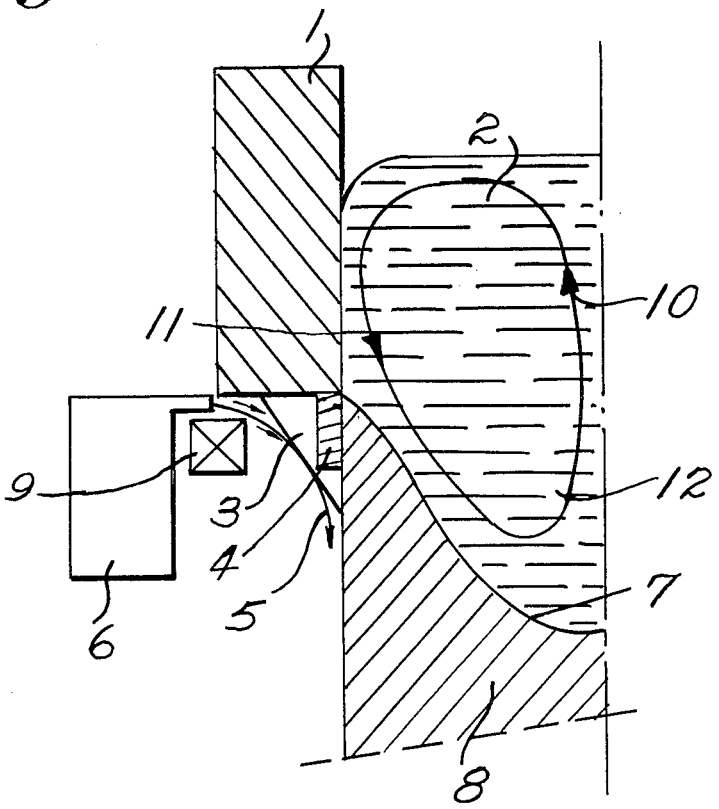
FIG. 1 is a vertical half section taken through the axis of a mold according to one embodiment of the invention.

Two types of arrangement are preferably used according to the invention: In one arrangement a single phase electric current at a frequency no higher than industrial frequency is passed through the downstream part of the mould, at least partially comprising an electrically conductive material. However, the wall of that portion must have an insert of electrically insulating material right through its thickness and along at least one generatrix, with power leads fixed to both sides of it. Thus this portion acts as a winding, and the current passing through it generates a magnetic field which develops electro magnetic forces generating the required movement. In addition, the inner wall of that portion must be covered with an electrically insulating film, so that there is no electrical continuity between the metal portion and the cast metal; such continuity would cause short circuiting and prevent the magnetic field responsible for the movement from developing. This arrangement is disclosed in U.S. Pat. No. 4,735,255.

Since the electro magnetic forces are dependent on the intensity of the current passing around the winding, it is preferable for the downstream portion to be made of metals which have low electrical resistivity but mechanical strength compatible with the metal being cast. Copper or aluminium and their alloys may, for example, be used in cases where aluminum is being cast.

It has also been found possible to use assemblies made up of different materials, where the portion closest to the upstream portion is made—if not of an insulating material—at least of a material which is a less good conductor of electricity than a stainless steel for example. Under these conditions the movement of the liquid can be intensified.

As for the insulating film, this may comprise a layer of oxide obtained by anodisation in the case of aluminium or an enamel, or a fluorocarbon resin for example. The thickness of the film will depend on the voltage at which the wall is relative to the metal being cast. An oxide thickness of 1 micron for a voltage of 100 volts may be taken as a basis.

The downstream parts may have a graphite ring a few millimetres thick fitted on their internal surface. The ring then acts as a lubricant for the metal being cast and may enhance the action of a lubricating agent, with which the inner wall of the downstream part sometimes has to be coated to facilitate casting some metals.

The ring may be divided into at least two sectors along its generatrices, not merely to avoid any Joule effect in the zone which has to be cooled, but also to reduce energy which would limit the movement of the metal.

In a special arrangement the ring may have an insert opposite the insert on the downstream portion; in this case the Joule effect is again avoided but the ring can then be shrunk directly onto the inner wall of said portion without any need for an intermediate insulating film.

The other way of moving the liquid in the mould comprises placing at least one metal winding outside the downstream portion of the mould, with its axis substantially parallel with the axis of the mould, and passing a single phase current through it at a frequency no higher than industrial frequency (50–60 Hz). This arrangement is described in U.S. Pat. No. 4,723,591. The winding is electrically insulated from the wall of that portion and creates a magnetic field parallel with the axis of the mould. This develops electro magnetic forces which generate the required movement. The movement will certainly vary in intensity and will depend on the strength of the current supplied to the winding, but it will also depend on other factors such as the composition of the material forming the wall of the cold zone or the structure of the wall.

As far as the composition of the cold zone is concerned, it is preferable to use a material with a resistivity of over 5 $\mu\Omega$. cm. It may, for example, be an amagnetic stainless steel or titanium, or a ceramic provided that it has adequate heat conductivity. Where aluminium is being cast the best way to avoid breaking with the practices of the art is to use aluminium, but in the form of an alloy containing (by weight) approximately 1.8% Mn; 0.25% Cr; 0.2% Ti and 0.1% V. This has a resistivity of 9.3 μΩ. cm as compared with the resistivity of conventional alloys, 3 μΩ. cm. However, the resistivity may be increased by adding up to 5% Mg, in which case values of 11 to 12 μΩ. cm will be obtained. The addition of up to 1% Li or up to 0.15% Zr is also helpful.

Other solutions comprise using composite materials, such as a stainless steel coated with a thin layer of aluminium on the inside.

As far as the structure of the cold zone is concerned, the current strength required for movement can be reduced by dividing the wall of the cold zone along its generatrices, into at least two sectors which are separated by an electrical insulator such as mica. The sectors can be held together by stainless steel pins and pegs of insulating material.

All these versions of the downstream portion may be fitted with a coaxial graphite ring on the internal wall in the vicinity of the hot zone. The ring should preferably be divided into at least two sections along its generatrices. The purpose of these special features is to make the electric current more effective in its conversion to electro magnetic forces generating movement.

All the windings surrounding the downstream portion of the mould are designed and mounted so that they can fit a downstream portion of any shape. They are also designed and mounted for optimum performance in obtaining both an optimum current-force yield and a force distribution in the metal such that the liquid moves over the whole cross-section and the whole height of the mould, thus causing the greatest possible degeneration of the dentrites on the greatest possible number of crystals.

Thus the windings can be displaced parallel with the axis of the mould or formed by an assembly of removable elements, which can extend around moulds of any cross-section at equal or different distances. These assemblies are ideal for the manufacture of products of rectangular section.

Other special features may be included in the invention, to make the movement of the metal more effective, such as adding at least one metal winding around the hot zone. The winding would have an electric current passing through it, and the winding or windings would be connected either to the winding(s) of the cold zone or to a current generator. The current from the generator would be of a different strength, frequency and/or phase from the current supplying the windings of the cold zone.

As a means of channelling the magnetic field created by the windings, the cold zone may be surrounded with magnetic yoke elements, formed by metal sheets which are electrically insulated from one another and located in planes passing through the axis of the mould.

The cold zone is cooled in known manner, either by using fluid containers integral with the outer wall of the zone, or by applying a peripheral expanse of fluid directly to the wall.

The flow rate and/or temperature of the fluid is adjusted according to the degree of cooling required and its positioning, to form crystals at the required speed in a given area, and to send them into the hot zone at the required stage of development. In the case of direct cooling the surfaces which make impact with the expanse of fluid are also adjusted.

The hot zone, or at least the part of it closest to the cold one, may be surrounded with a sheath, with a pressurised gas which is chemically inert relative to the cast metal circulating inside it. The cast product is found to have a better surface appearance under these conditions.

The invention will be understood better by studying FIG. 1, which is a vertical half section taken through the axis of a mould suitable for the invention. In FIG. 1 an upstream portion 1 made of heat insulating material contains the liquid metal 2 and forms the hot zone. A downstream portion 3 made of heat conductive material has a graphite ring 4 fitted inside it and is cooled externally by a film 5 of water emerging from a supply container 6 which forms the cold zone. The cooling effect produced by the water makes the metal solidify along the surface 7 to give the cast product 8.

A coil 9 supplied with alternating current surrounds the cold zone and creates a magnetic field. This induces electro magnetic forces, so that the liquid metal is displaced in the direction of the arrow 10, parallel with the axis of the mould, towards the hot zone and returns to the cold zone along the wall of the mould in the direction of the arrow 11, drawing the particles 12 along with it.

Figure 3:
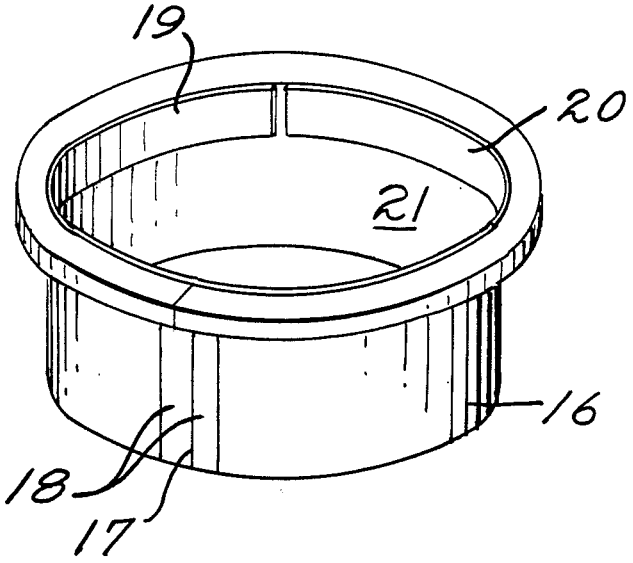
FIG. 3 is a perspective view of a bottom portion of a mold according to another embodiment of the invention.

In an alternative embodiment of the invention shown in FIG. 3, current may be passed directly through the downstream portion of the mold. In this embodiment, downstream portion 16 has an electrically insulating material 17 passing through the thickness of the downstream portion along one generatrix. Terminals 18 are located on both sides of the insulating material. A graphite ring is provided on the inside of the downstream portion, split into two sectors 19 and 20 along the generatrices of the mold. The inner wall of the downstream portion is covered with an insulating film 21.

Figure 4:
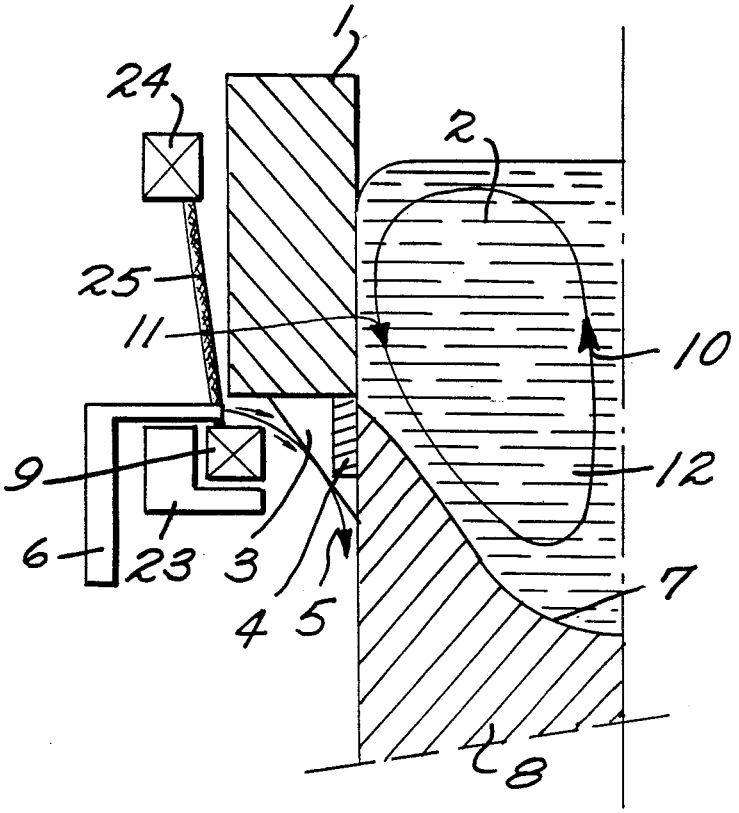
FIG. 4 is a vertical half section taken through the axis of a mold according to still another embodiment of the invention.

FIG. 4 shows an embodiment similar to FIG. 1, but containing special features to make the movement of metal more effective. Thus, a metal sheet 23 serving as a magnetic yoke element is located at the cold zone adjacent to winding 9. Further, a winding 24 is also provided around the hot zone, the winding being electrically connected to the winding 9 of the cold zone by way of conductor 25.

The following examples of how the invention can be applied are given to illustrate the invention.

EXAMPLE 1

Figure 2:
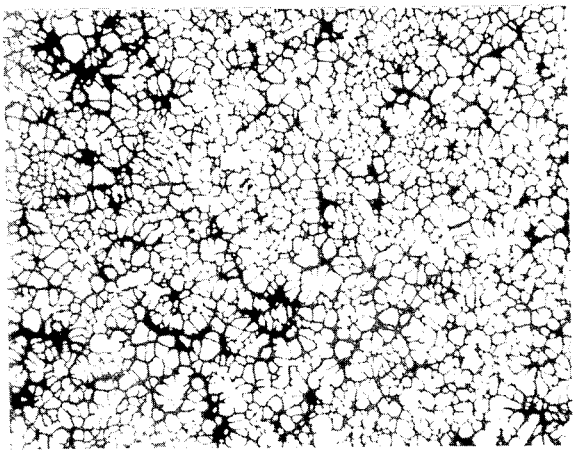
FIG. 2 is a photomicrograph of material cast in the mold of the invention.

A billet 70 mm is diameter made of type AS/GO,3 aluminium alloy (i.e. containing 7% by weight Si and 0.3% by weight Mg) was produced by the method described above:

the upstream portion was formed by a ring of MONALITE 50 mm high the downstream portion, made of aluminium, was covered internally with a thin anodised layer (5 micron) and with a graphite ring divided into 12 sectors, and was split in two over its whole height. The current circulated directly through the downstream portion, to which two power leads had been fixed, one on either side of the split. The voltage at the terminals of the leads was then 1.05 volts. The casting speed was 200 mm/min, the speed conventionally used for billets of this diameter. An example of the structure obtained inside the billet, which was examined by micrography (see 50 fold enlargement in FIG. 2) shows the effectiveness of the process in obtaining a structure with degenerate dendrites.

EXAMPLE 2

A 2124 alloy (according to the standards of the Aluminium Association) was cast in the form of a billet 400 mm in diameter by the method described. The overall design of the equipment was similar to that described in the previous example, except for the passage of the current; in this case it passed through a winding independent of the downstream portion. The casting speed was 40 mm/min, the speed conventionally used for billets of that diameter.

Micrographic examination showed that, except for a peripheral zone of approximately 15 mm, the grain structure was particularly rounded, virtually without any dendrite arms and very small in size, of the order of 70 microns.

EXAMPLE 3

Plates 800×300 mm made of alloy 7075 (according to the standards of the Aluminium Association) were cast by the method described. As in the case of the 400 mm diameter billet, a winding surrounded the outer surface of the downstream portion, a short distance away from it (10 mm). The winding in fact comprised 4 copper bar elements which were cooled internally with water. The elements were connected to one another in three of the corners and to the power leads in the fourth. The casting speed was 60 mm/min.

Macrographic examination of the cast product revealed a fine, homogeneous structure, except for the corners which had a still finer structure. Micrographic examination showed a marked change in the morphology of the grains, which took on "potato" shapes instead of the conventional "cauliflower" shapes. A selective action designed to reveal the arms of the dendrites showed that they had almost completely disappeared.

What is claimed:

1. A method of making thixotropic metal products by continuous casting, comprising:

pouring liquid metal into a continuous casting mold including an upstream portion having a wall made of heat insulating material at least on its inner surface to form a hot zone, a downstream portion having a well made at least partially of a heat conducting material to form a cold zone, and a movable end at one extremity;

cooling the outer surface of the downstream portion with a heat exchanging fluid, thereby causing the formation of crystals in the liquid metal by solidification in the cold zone, and causing the formation of a solid crust of metal on contact with the inner surface of the downstream portion;

moving the movable end so as to extract metal product supported by said crust from the mold; and causing circulation of liquid metal within the mold in a cycle from the cold zone to the hot zone and back to the cold zone to cause said crystals to remelt at the surface and promote the degeneration of dendrites, the period of transfer between zones being $\leqq 1$ second.

2. The method of claim 1, wherein the circulation takes place in loops located in meridian planes, which together generate a torus with its axis substantially identical with the axis of the mould.

3. The method of claim 1, wherein the inner wall of the cold zone is covered with a lubricating agent.

4. The method of claim 1, comprising causing said circulation by passing a monophase electric current of a frequency no higher than industrial frequency within the downstream portion of the mold, said downstream portion having an insert of electrical insulating material right through its thickness and along at least one generatrix of the mold, with power leads fixed one on each side of the insert, and said downstream portion being coated internally with an electrically insulating film.

5. The method of claim 4, wherein the inner wall of the cold zone is covered with a graphite ring coaxial with the hot and cold zones, over its whole periphery and at least in the vicinity of the hot zone.

6. The method of claim 5, wherein the graphite ring is divided into at least two sectors along the generatrices of the mold.

7. The method of claim 1, comprising causing circulation by means of at least one metal winding placed outside the cold zone of the mold with the axis of the winding substantially parallel with the axis of the mold, said winding having passed therethrough a monophase current at a frequency no higher than the industrial frequency.

8. The method of claim 7, wherein the cold zone is made of solid material with a resistivity over 5 $\mu\Omega$. cm.

9. The method of claim 7, wherein the cold zone is divided along the generatrices of the mold into at least two sectors, which are separated by an electrical insulator.

10. The method of claim 7, wherein the cold zone is made of a combination of different materials.

11. The method of claim 7, wherein the inner wall of the cold zone is covered with a graphite ring coaxial with the hot and cold zones, over its whole periphery and at least in the vicinity of the hot zone.

12. The method of claim 11, wherein the graphite ring is divided into at least two sectors along the generatrices of the mold.

13. The method of claim 7, wherein the at least one winding is displaced parallel with the axis of the mould.

14. The method of claim 7, wherein the distance between the at least one winding and the outer wall of the cold zone is adjustable.

15. The method of claim 1, wherein the hot zone contains at least one metal winding which is supplied with electric current.

16. The method of claim 7, wherein the hot zone contains at least one metal winding supplied with electric current, and the winding is connected to the winding outside the cold zone.

17. The method of claim 4, wherein the cold zone is surrounded by laminated magnetic yoke elements, with the individual sheets located in planes passing through the axis of these zones.

18. The method of claim 1, wherein the cold zone is cooled by means of a refrigerating fluid with a variable flow rate.

19. The method of claim 1, wherein the cold zone is cooled by means of a refrigerating fluid with a variable temperature.

20. The method of claim 1, wherein the cold zone is cooled by means of a refrigerating fluid which cools the zone in specific locations.

21. The method of claim, wherein a pressurised gas is injected at the level of the cold zone.

22. A method according to claim 1, wherein the metal is an aluminum alloy.

23. The method of claim 7, wherein the hot zone contains at least one winding which is connected to the current passed within the downstream portion.

* * * * *